US011812851B2

(12) United States Patent
Larkner et al.

(10) Patent No.: US 11,812,851 B2
(45) Date of Patent: Nov. 14, 2023

(54) STORAGE DEVICE WITH DRAWER RETAINER AND STABILIZER

(71) Applicant: HELMER SCIENTIFIC, LLC, Noblesville, IN (US)

(72) Inventors: Thomas J. Larkner, Noblesville, IN (US); Bryan T. Shannon, Fishers, IN (US); Grant Balbach, Ferdinand, IN (US)

(73) Assignee: HELMER SCIENTIFIC, LLC, Noblesville, IN (US)

( * ) Notice: Subject to any disclaimer, the term of this patent is extended or adjusted under 35 U.S.C. 154(b) by 0 days.

(21) Appl. No.: 17/859,640

(22) Filed: Jul. 7, 2022

(65) Prior Publication Data

US 2022/0338628 A1 Oct. 27, 2022

Related U.S. Application Data

(62) Division of application No. 16/967,002, filed as application No. PCT/US2019/016292 on Feb. 1, 2019, now Pat. No. 11,439,232.

(60) Provisional application No. 62/625,546, filed on Feb. 2, 2018.

(51) Int. Cl.

| | |
|---|---|
| ***A47B 88/57*** | (2017.01) |
| ***A47B 88/43*** | (2017.01) |
| ***A47B 88/477*** | (2017.01) |
| ***A47B 88/417*** | (2017.01) |

(52) U.S. Cl.

CPC ..... *A47B 88/57* (2017.01); *A47B 88/417* (2017.01); *A47B 88/43* (2017.01); *A47B 88/477* (2017.01)

(58) Field of Classification Search

CPC ..... A47B 88/57; A47B 88/417; A47B 88/43; A47B 88/477

See application file for complete search history.

(56) References Cited

U.S. PATENT DOCUMENTS

| | | | | |
|---|---|---|---|---|
| 879,690 A | | 2/1908 | Starrett | |
| 2,319,283 A | | 5/1943 | Zalkind | |
| 2,337,079 A | | 12/1943 | Zalkind | |
| 2,410,701 A | | 11/1946 | Zalkind | |
| 2,620,252 A | | 12/1952 | Restivo | |
| 2,656,238 A | | 10/1953 | Adler | |
| 2,992,057 A | * | 7/1961 | Maxwell | A47B 88/43 312/332 |

(Continued)

FOREIGN PATENT DOCUMENTS

| | | | | |
|---|---|---|---|---|
| JP | 2008012014 A | * | 1/2008 | A47B 57/40 |
| JP | 2011172830 A | * | 9/2011 | A47B 88/16 |

(Continued)

OTHER PUBLICATIONS

PCT Search Report and Written Opinion prepared for PCT/US2019/016292, completed Mar. 20, 2019.

*Primary Examiner* — Hanh V Tran

(74) *Attorney, Agent, or Firm* — Womble Bond Dickinson (US) LLP

(57) ABSTRACT

An apparatus and method for storing medical products such as pharmaceutical and medical products in climate controlled storage devices includes an enclosure and a plurality of storage drawers contained within the enclosure. The enclosure includes a plurality of walls and a storage-drawer support. The plurality of storage drawers are supported in the enclosure by the storage-drawer support.

17 Claims, 5 Drawing Sheets

(56) References Cited

U.S. PATENT DOCUMENTS 3,038,774 A * 6/1962 Cyrus ..... A47B 88/43 312/350
3,097,901 A * 7/1963 Schless ..... A47B 57/08 312/330.1
3,241,902 A 3/1966 Hamilton et al.
3,261,585 A * 7/1966 Costantini ..... F25D 25/02 312/351
3,782,800 A 1/1974 Remington et al.
3,826,552 A * 7/1974 Anderson ..... A47B 88/477 312/270.3
4,239,306 A 12/1980 Klaus
4,453,790 A 6/1984 Cohen et al.
4,834,555 A * 5/1989 Grass ..... A47B 88/43 384/22
5,123,721 A * 6/1992 Seo ..... G11B 33/124
5,211,461 A * 5/1993 Teufel ..... A47B 88/417 312/334.44
5,262,923 A 11/1993 Batta et al.
5,806,949 A * 9/1998 Johnson ..... G06F 1/184 312/334.7
6,299,266 B1 * 10/2001 Justice ..... G06F 1/184 292/87
6,312,186 B1 * 11/2001 Rock ..... F16B 12/34 403/353
6,412,891 B1 7/2002 Liang et al.
7,344,209 B1 3/2008 Miyashiro
8,960,822 B1 2/2015 Hsu
8,971,036 B1 * 3/2015 Lau ..... G06F 1/20 361/679.34
9,363,921 B1 * 6/2016 Chen ..... H05K 7/1489
9,386,847 B1 * 7/2016 Jeffries ..... A47B 88/417
9,468,128 B2 * 10/2016 Cheng ..... H05K 7/1489
9,717,335 B2 8/2017 Zhang
10,285,501 B2 * 5/2019 Hamon ..... A47B 88/45
10,299,586 B1 * 5/2019 Powwarynn ..... A47B 88/423
10,327,547 B1 6/2019 Shih et al.
10,524,587 B2 * 1/2020 Rosner ..... B25H 3/028
2003/0075006 A1 4/2003 Coffin et al.
2003/0205955 A1 * 11/2003 Egger ..... A47B 88/43 312/334.5
2007/0252496 A1 11/2007 Remondino
2008/0093320 A1 4/2008 Glover
2012/0017414 A1 * 1/2012 Cerniglia ..... A47B 88/43 29/700
2013/0169137 A1 7/2013 Susnjara
2013/0278124 A1 10/2013 Hu
2015/0022071 A1 * 1/2015 Chen ..... G07F 11/04 312/334.8
2015/0048732 A1 2/2015 Gutierrez et al.
2015/0098186 A1 * 4/2015 Alshinnawi ..... H05K 7/20736 361/679.58
2015/0163953 A1 * 6/2015 Chapel ..... H05K 7/1489 29/428
2015/0230605 A1 8/2015 Miyake
2015/0327676 A1 11/2015 Chang
2016/0174707 A1 6/2016 Chan et al.
2016/0264368 A1 * 9/2016 Sugishima ..... B65H 1/266
2016/0286958 A1 10/2016 Cinello et al.
2019/0124783 A1 * 4/2019 Chapel ..... H05K 7/1489

FOREIGN PATENT DOCUMENTS

JP 2017193437 A 10/2017
KR 2013/0033013 A 4/2013
WO WO2005070257 A1 8/2005
WO 2015140433 A1 9/2015

* cited by examiner

STORAGE DEVICE WITH DRAWER RETAINER AND STABILIZER

CROSS-REFERENCE TO RELATED APPLICATIONS

This application is a divisional application of U.S. application Ser. No. 16/967,002 filed Aug. 3, 2020, which claims priority to PCT International Application Number PCT/US2019/016292 filed Feb. 1, 2019, which claims priority under 35 U.S.C. § 119(e) to U.S. Provisional Application Ser. No. 62/625,546 filed on Feb. 2, 2018, the entire disclosures of which are incorporated herein by reference.

TECHNICAL FIELD

The present disclosure is related to a storage device. More specifically, the present disclosure is related to a storage device with a plurality of drawers.

BACKGROUND

Medical supplies such as pharmaceuticals and blood products are a high value commodity requiring stringent quality and inventory control measures. Medical products including medications, tissues, and blood products such as whole blood, plasma, or platelets, for example, are in limited supply and have a limited shelf life and stringent quality control requirements to maintain the quality of the products. It is desirable to store these medical products in devices that are ergonomic and customizable for the product they are storing.

SUMMARY OF THE INVENTION

The present application discloses one or more of the features recited in the appended claims and/or the following features which, alone or in any combination, may comprise patentable subject matter:

According to one aspect of the present disclosure, a storage device comprises an enclosure, a storage drawer, and a drawer retainer. The enclosure includes a plurality of walls that cooperate to define an internal space within the enclosure and a storage-drawer support coupled to at least one wall in the internal space. The storage drawer is movable relative to the storage-drawer support along a path within the internal space from a closed position to an opened position, the storage drawer contained within the internal space in the closed position and the storage drawer having a portion located in the internal space and a portion located outside the internal space in the opened position. The drawer retainer is removably coupled to the enclosure outside of the internal space and configured to change from a locked configuration to an unlocked configuration. The drawer retainer is further configured to extend into the internal space and engage the storage drawer in the locked configuration to block movement of the storage drawer further away from the enclosure when the storage drawer is in the opened position and configured to disengage selectively from the enclosure so that the storage drawer is movable to disengage from the storage-drawer support when the retainer is in the unlocked configuration.

According to another aspect of the present disclosure, a storage device comprises an enclosure, a storage drawer, and a drawer stabilizer. The enclosure includes a plurality of walls that cooperate to define an internal space within the enclosure and a storage-drawer support coupled to at least one wall in the internal space. The storage drawer is movable relative to the storage-drawer support along a path within the internal space from a closed position to an opened position, the storage drawer contained within the internal space in the closed position and the storage drawer having a portion located in the internal space and a portion located outside the internal space in the opened position. The drawer stabilizer is coupled to the enclosure between a wall and the storage drawer support, the drawer stabilizer configured to provide an inward force on the storage drawer to minimize lateral movement of the storage drawer relative to the enclosure.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
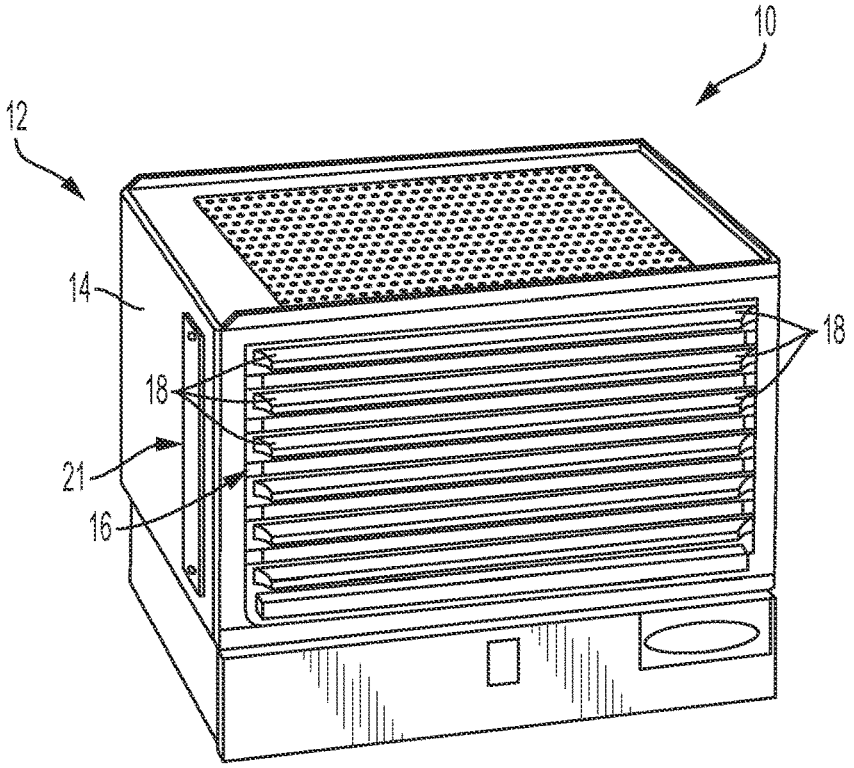
FIG. 1 is a perspective view of a storage unit illustratively embodied as an agitator having an enclosure and a plurality of storage drawers within the enclosure.
Figure 3:
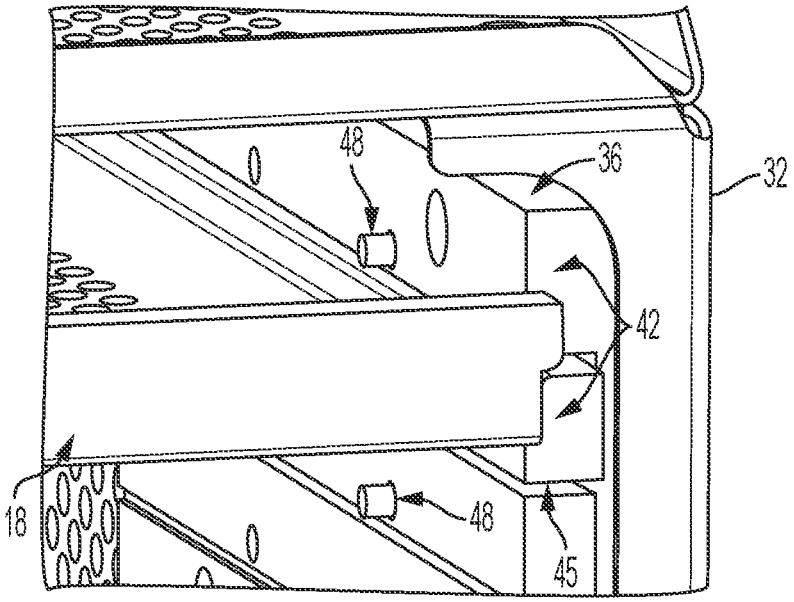
FIG. 3 is an enlarged perspective view of a storage drawer supported in the enclosure in a closed position.
Figure 4:
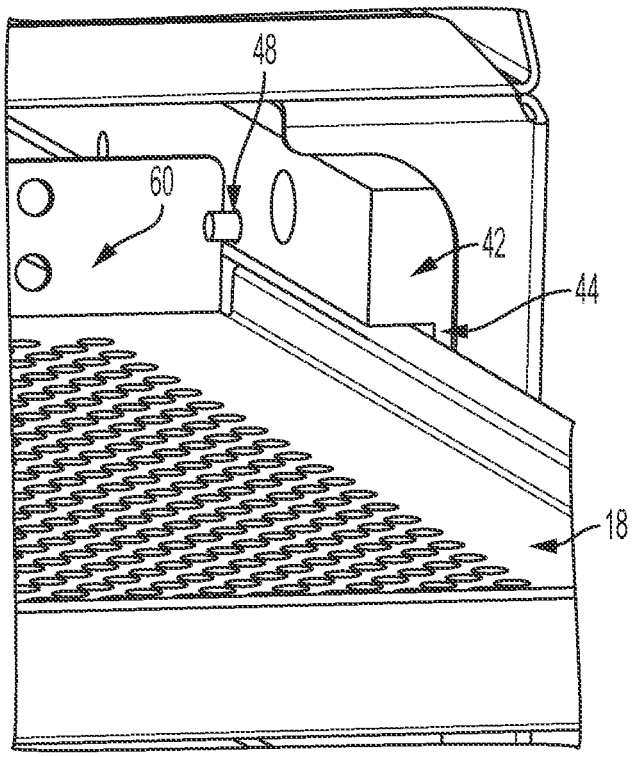
FIG. 4 is an enlarged perspective view of the storage drawer supported in the enclosure in an opened position and retained in the opened position by a retainer.

A storage device 10 illustratively embodied as a platelet agitator 12 as shown in FIG. 1. An example of an agitator is shown and described in U.S. Pat. No. 7,638,100 which is incorporated herein in its entirety. The storage device 10 includes an enclosure 14 forming an internal space 16 and a number of storage drawers 18 positioned in the internal space 16. Each storage drawer 18 is movable relative to the storage drawer support along a path defined by the storage support. The storage drawers 18 travel along the path from a closed position as shown in FIG. 3 to an opened position as shown in FIG. 4. The storage drawers 18 are contained within the enclosure 14 in the closed position. The storage drawers slide outwardly from the enclosure so that a portion of the drawers 18 remain within the enclosure and a portion of the drawers 18 is arranged outside of the enclosure for access to contents in the storage drawers 18. It should be understood that the enclosure 10 is positioned internal to the enclosure 14 and is movable relative to the enclosure 14 as discussed in the U.S. Pat. No. 7,638,100 to agitate bags of platelets stored on the storage drawers 18. As such, the agitation tends to cause some vibration and movement of the drawers 18 relative to the enclosure 14 in prior platelet agitator systems. This vibration may be sustained while the drawers 18 are opened to access material stored on the drawers 18. Thus, there is a need to support the drawers 18 during vibration and to provide stabilization of the drawers 18. As described below, the present disclosure is directed to providing stabilization for the drawers 18 in use.

The enclosure 14 is rectangular and includes a plurality of walls 20 that define the internal space 16 and a storage drawer support 22 coupled to the enclosure 14 within the internal space 16. Illustratively the plurality of walls 20 define the rectangular shape of the enclosure 14 and includes a ceiling 24, a floor 26, and first, second, and third side walls 28, 30, 32 that extend from the ceiling 24 to the floor 26. The enclosure 14 may further include a door (not shown) that may be opened to allow access to the internal space 16 and closed to block access to the internal space 16. The storage drawer support 22 is coupled to the first and third side walls 28, 32 and extends from the ceiling 24 to the floor 26 to support the storage drawers 18 on top of one another in the internal space 16.

Figure 2:
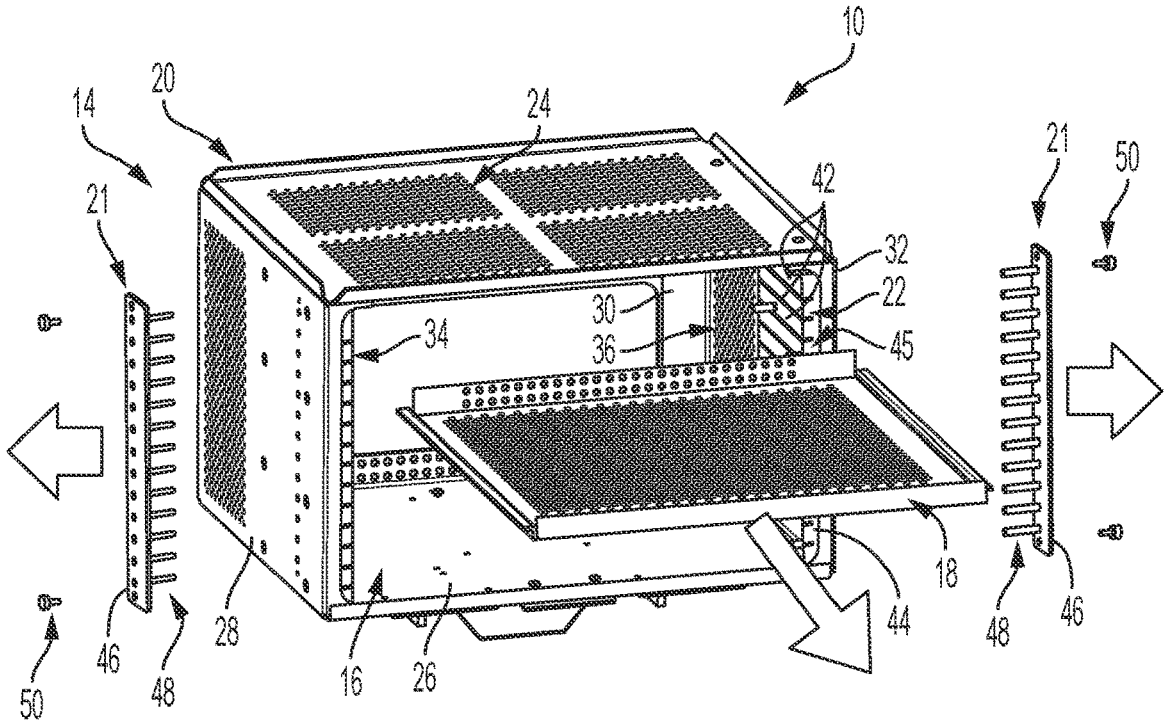
FIG. 2 is a partial exploded assembly and diagrammatic view of the storage unit with the storage drawers removed from the enclosure.

The storage drawer support 22 includes a left support unit 34 and a right support unit 36 as shown in FIG. 2. The left support unit 34 is coupled to the first wall 28 and is configured to support a left side 38 of each storage drawer 18. The right support unit 36 is coupled to the third side wall 32 and is configured to support a right side 40 of each storage drawer 18.

Each support unit 34, 36 includes a plurality of support beams 42 and a plate 44. The plurality of support beams 42 are spaced apart from one another and are stacked from the floor 26 to the ceiling 24. Gaps 45 are provided between adjacent support beams 42 included in the plurality of support beams 42 to receive the left and right sides 38, 40 of the storage drawers 18. The plate 44 is coupled to the plurality of support beams 42 between a respective side wall 28, 32 of the enclosure 14 and the plurality of support beams 42.

Figure 8:
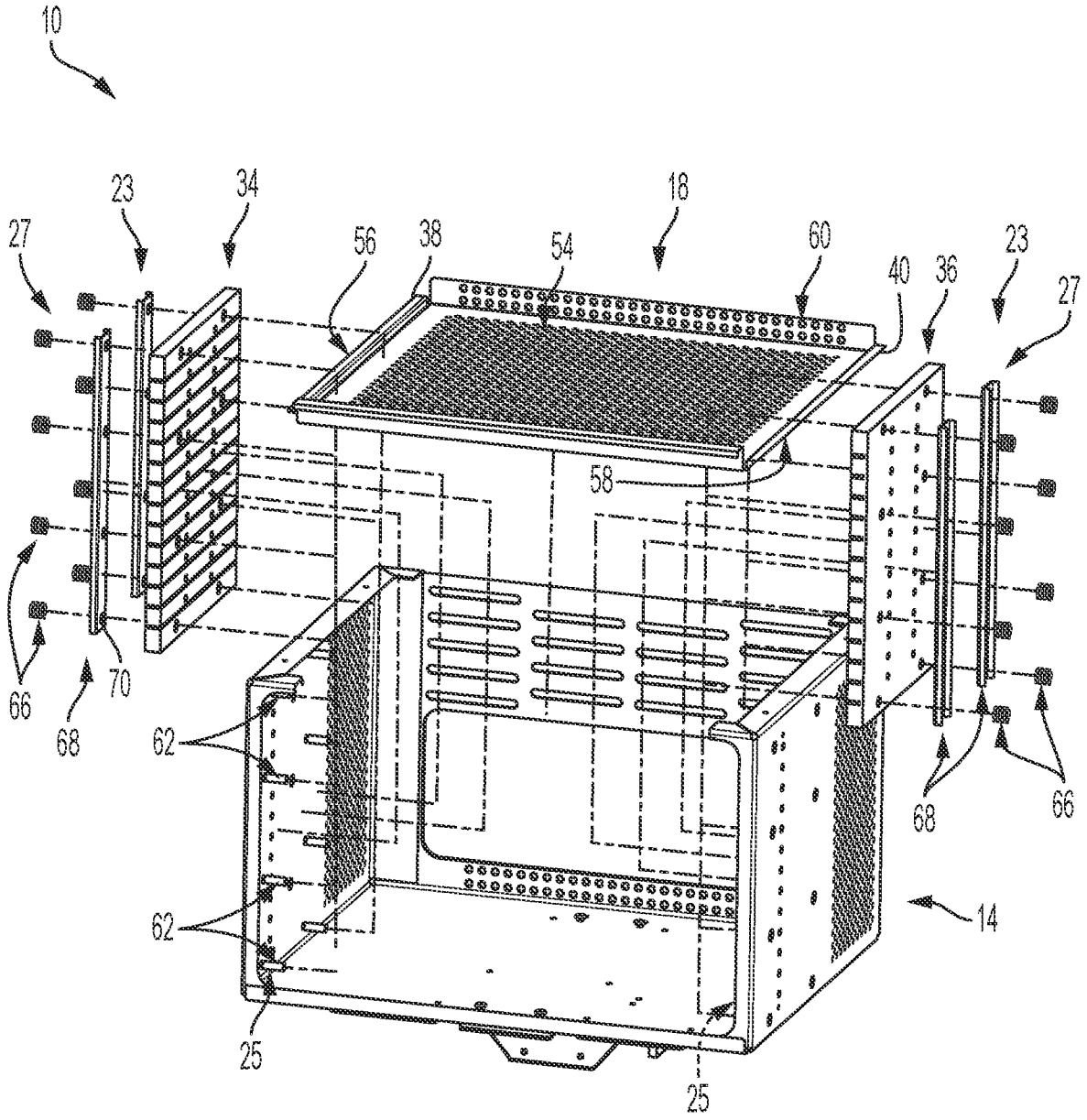
FIG. 8 is an exploded assembly view of the storage device showing a pair of drawer stabilizers.

The storage device 10 further includes a pair of drawer retainers 21 coupled to an exterior of the enclosure 14 as shown in FIG. 2 and a pair of drawer stabilizers 23 as shown in FIG. 8. The drawer retainers 21 are arranged to extend from the exterior of the enclosure 14 and protrude into the internal space 16 as shown in FIGS. 3 and 4. The drawer retainers 21 engage the storage drawers 18 in the opened position to block movement of the storage drawers 18 further away from the enclosure 14 as shown in FIG. 4. The drawer stabilizers 23 are configured to apply inward forces on the storage drawers 18 to block lateral movement of the storage drawers 18 in the internal space 16.

Each drawer retainer 21 is removably coupled to the enclosure 14 outside of the internal space 16 and may be changed from a locked configuration as shown in FIG. 1 to an unlocked configuration as shown in FIG. 2. The drawer retainers 21 are fastened to the enclosure 14 in the locked configuration and are unfastened and disengaged from the enclosure 14 in the unlocked configuration. All of the storage drawers 18 are removable selectively from the internal space 16 when the drawer retainers 21 are in the unlocked configuration to raise or lower each storage drawer 18 within the internal space 16 as shown in FIG. 2. Similarly, all of the storage drawers 18 are blocked from further movement away from the enclosure 14 when the drawer retainers 21 are in the locked configuration.

Figure 9:
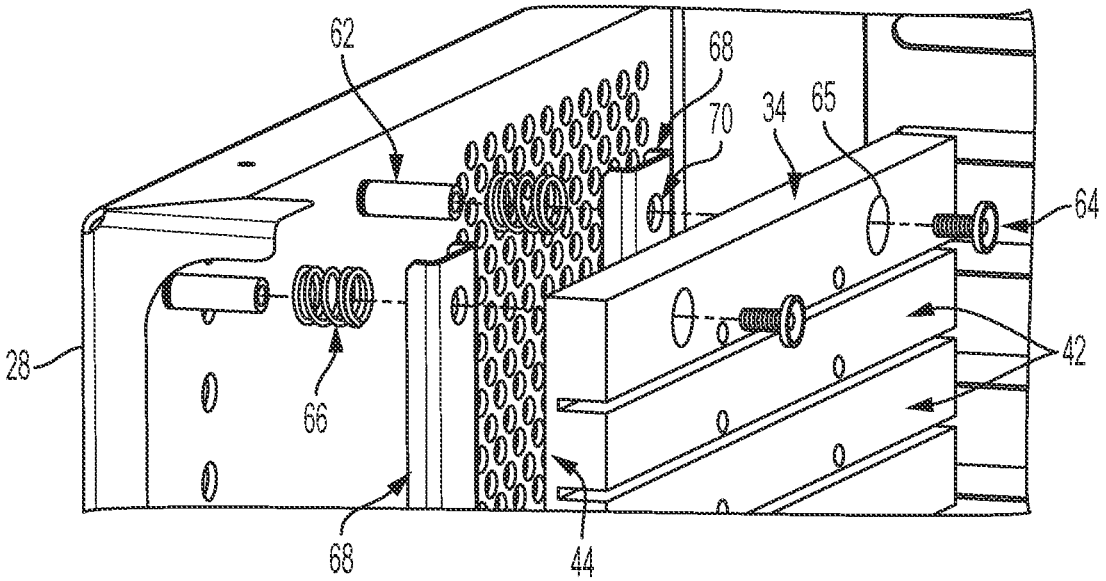
FIG. 9 is a perspective and partial exploded assembly view of the storage device and a drawer stabilizer.
Figure 10:
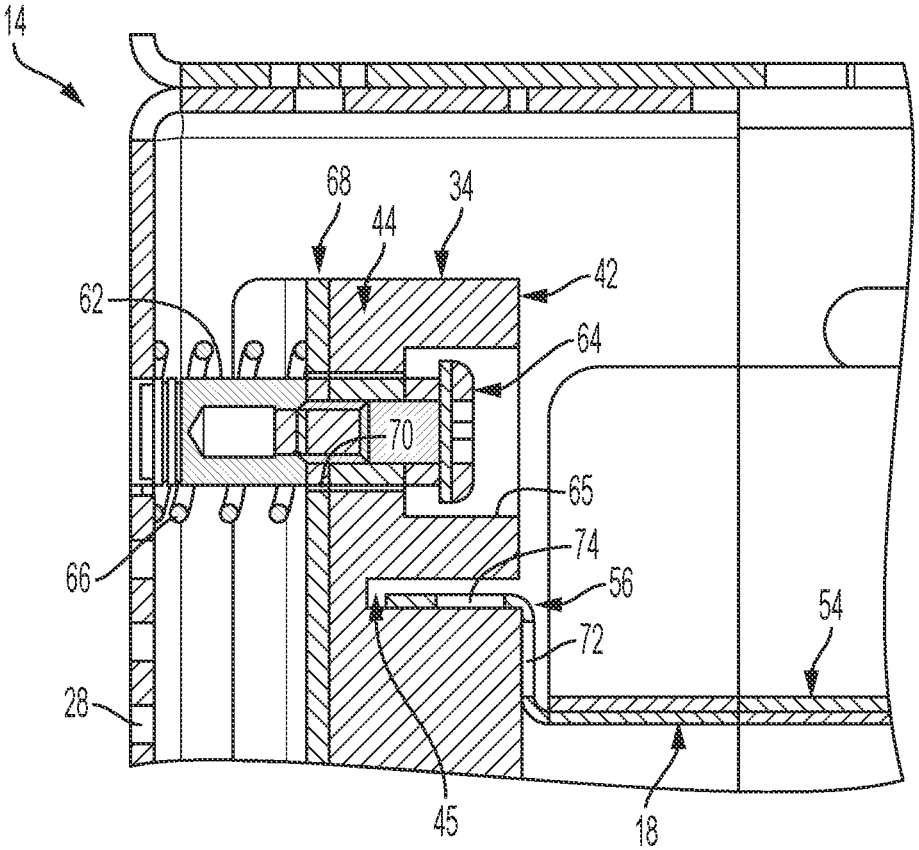
FIG. 10 is a sectional view of the storage device and the drawer stabilizer.

The drawer stabilizers 23 bias the support units 34, 36 inwardly to minimize a distance between the support units 34, 36 and the left and right sides 38, 40 of the storage drawers 18. Each drawer stabilizer 23 includes a mount system 25 and a bias system 27 as shown in FIGS. 8-10. Each mount system 25 couples a respective support unit 34, 36 to the enclosure and allows lateral movement of the support units 34, 36 relative to the enclosure 14. Each bias system 27 is configured to bias a respective support unit 34, 36 inwardly toward the internal space 16 such that the support units are spaced apart from the enclosure 14.

In the illustrative embodiment, a pair of drawer retainers 21 is included in the storage device 10. However, only one drawer retainer 21 may be included in the storage device. In another example, any suitable number of drawer retainers 21 may be used.

Each drawer retainer 21 includes a back plate 46, a plurality of retainer posts 48, and fasteners 50 as shown in FIGS. 2 and 5-7. The back plate 46 is arranged to lie on the exterior of the enclosure when the drawer retainer 21 is in the locked configuration. The plurality of retainer posts 48 are arranged to extend from the back plate 46 and through the enclosure 14 and the support units 34, 36. The plurality of posts 48 protrude into the internal space 16 where they engage the storage drawers 18 in the opened position to block further movement of the storage drawers 18 away from the enclosure 14. The fasteners 50 secure each drawer retainer 21 to the enclosure 14.

The back plate 46 is arranged to extend from the ceiling 24 of the enclosure 14 to the floor 26 of the enclosure 14 as shown in FIG. 2. The retainer posts 48 are aligned vertically on the back plate 46 and are spaced apart equal distances from the ceiling 24 of the enclosure 14 to the floor 26 of the enclosure 14. However, any suitable arrangement and spacing of the retainer posts 48 on the back plate 46 may be used.

Illustratively, each drawer retainer 21 includes thirteen retainer posts 48. Each of the retainer posts 48 may engage a respective storage drawer 18. However, any suitable number of retainer posts 48 may be used depending on the number of drawers 18 included in the storage device 10. Additionally, the storage device 10 may include a number of storage drawers 18 that is less than a number of retainer posts 48.

The fasteners 50 in the illustrative embodiment include thumbscrews that may be manually twisted to fasten or remove the fasteners 50 from the enclosure 14. However, in other embodiments any suitable fastener may be used to secure the drawer retainers 21 to the exterior of the enclosure 14. Additionally, any suitable method of fastening may be used such as, for example, mechanical fastening, magnetic fastening, adhesive fastening, hook and loop structures, or key and slot structures. In another example, the back plate 46 is coupled permanently to the exterior of the enclosure 14 and the retainer posts 48 are removeably coupled to the back plate 46 or the enclosure 14 using any of the methods or structures described above.

Figure 5:
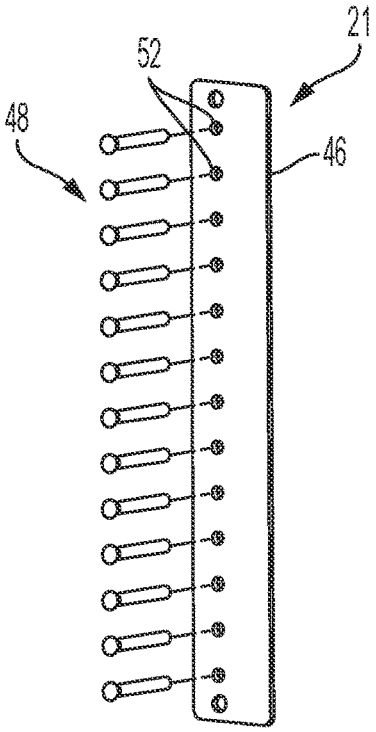
FIG. 5 is an exploded assembly view of the retainer.
Figure 6:
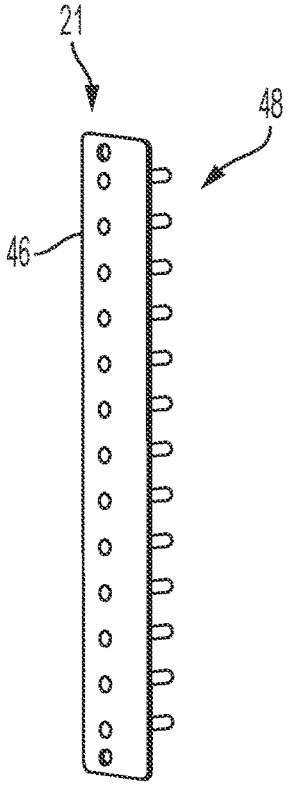
FIG. 6 is a perspective view of the retainer.
Figure 7:
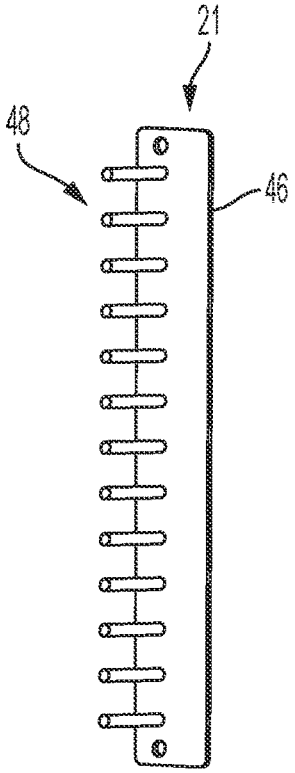
FIG. 7 is another perspective view of the retainer.

The retainer posts 48 in the illustrative embodiment are arranged to extend through respective post apertures 52 formed in the back plate 46 as shown in FIG. 5. The retainer posts 46 may be coupled to the back plate 46 using any suitable method such as, for example, by press fitting each retainer post 48 to the back plate 46 or by spot or capacitive welding each retainer post 48 to the back plate 46.

In the illustrative embodiment, a pair of drawer stabilizers 23 is included in the storage device 10 as shown in FIG. 8. However, only one drawer stabilizer 23 may be included in the storage device 10. In another example, any suitable number of drawer stabilizers 23 may be used.

The mount system 25 and the bias system 27 of a drawer stabilizer 23 are described below and shown in FIGS. 9 and 10. Although one drawer stabilizer 23 is described in relation to support unit 34, right support unit 36 is similar to left support unit 34. As such, right support unit 36 cooperates with a respective drawer stabilizer similarly to the relationship described below relating to left support unit 34.

The mount system 25 of each drawer stabilizer 23 includes a mount post 62 and a fastener 64 as shown in FIGS. 9 and 10. The mount post 62 is coupled to a side wall of the enclosure 14 and extends inwardly into the internal space 16. The mount post 62 is received in a mount post aperture 65 formed in the support unit 34 and blocks upward and downward movement of the support unit 34 relative to the mount post 62 and the enclosure 14. The fastener 64 is received in the mount post 62 and is spaced apart from the support unit 34 to allow lateral movement of the support unit 34 relative to the mount post 62.

The biasing system 27 includes a biasing spring 66 and a support flange 68 as shown in FIGS. 8-10. The biasing spring 66 extends between a side wall of the enclosure to the support flange 68 and provides the inward force on the support unit 34. The biasing spring 66 may be a coil spring, a leaf spring, a wire spring, or any other suitable device capable of providing the inward force on the support unit 34. The support flange 68 is formed to include a mount post aperture 70 that is arranged to receive the mount post 62. The biasing system 27 is configured to bias the support flange 68 toward the support unit 34 so that the support flange 68 and the support unit 34 are spaced apart from the side wall of the enclosure 14. In other embodiments, the biasing system may not include a support flange 68 and the biasing system 27 is configured to provide the inward force directly to the support unit 34.

In the illustrative embodiment, each mount system 25 includes two columns of mount posts 62 coupled to respective side walls of the enclosure 14 as shown in FIG. 8. In other embodiments, any suitable number of columns may be used. In the illustrative embodiment, each column of mount posts 62 includes four mount posts aligned vertically from the ceiling 24 to the floor 26. In other embodiments, any suitable number of mount posts may be included in each column. In some embodiments, the mount posts 62 of each column may be spaced apart from one another equal distances along the side wall. In other embodiments, any suitable spacing of the mount posts may be used.

In the illustrative embodiment, a support flange 68 is provided for each column of mount posts. In other embodiments, any suitable number of support flanges may be used. In other embodiments, the support flanges may be arranged along rows of mount posts. In the illustrative embodiment, each support flange 68 includes a plurality of mount post apertures 70 to complement the number of mount posts 62 included in each column. In other embodiments, any suitable number of apertures 70 may be used.

Each storage drawer 18 includes a basin 54, first and second side rails 56, 58, and a drawer stop 60 as shown in FIG. 8. The basin 54 is arranged to extend from the left support unit 34 to the right support unit 36. The left side rail 56 is arranged on the left side 38 of each storage drawer 18 and is received within a gap 45 between adjacent support beams included in the plurality of support beams 42 of the left support unit 34. The right side rail 58 is arranged on the right side 40 of each storage drawer 18 and is received within a gap 45 between adjacent support beams included in the plurality of support beams 42 of the right support unit 36. The drawer stop 60 is configured to engage a retainer post 48 when the storage drawer 18 is in the opened position.

The drawer stop 60 extends upwardly from the basin 54 as shown in FIG. 4. In the illustrative embodiment, the drawer stop 60 is formed as an extension of the basin and is bent upwardly so that the drawer stop 60 interferes with a retainer post 48 to block movement of the drawer 18 further away from the enclosure 14 in the opened position.

The left side rail 56 includes an upwardly extending flange 72 and an outwardly extending flange 74 as shown in FIG. 10. The upwardly extending flange 72 is coupled to the basin 54. The outwardly extending flange 74 is coupled to the upwardly extending flange 72 and is received within a gap 45 provided between adjacent support beams 42 included in the left support unit 34. The inward force provided by the biasing spring 66 is transferred from the support unit 34 to the upwardly extending flange 72. As such, a distance between support unit 34 and the storage drawer 18 is minimized or eliminated.

The right side rail 58 is similar to the left side rail 56 and cooperates with the right support unit 36 similarly to the relationship between the left side rail 56 and the left support unit 34. As such, although only left side rail 56 is shown in FIGS. 9 and 10, right side rail 58 is similar to left side rail 56. As such, right ride rail 58 cooperates with a respective support unit 36 similarly to the relationship described above relating to left side rail 56 and respective support unit 34.

Although certain illustrative embodiments have been described in detail above, variations and modifications exist within the scope and spirit of this disclosure as described and as defined in the following claims.

What is claimed is:

1. A storage device comprising an enclosure including a plurality of walls that cooperate to define an internal space within the enclosure and a storage-drawer support coupled to at least one wall in the internal space, a storage drawer movable relative to the storage-drawer support along a path within the internal space from a closed position to an opened position, the storage drawer contained within the internal space in the closed position and the storage drawer having a portion located in the internal space and a portion located outside the internal space in the opened position, and a drawer stabilizer coupled to the enclosure between the at least one wall and the storage-drawer support, the drawer stabilizer configured to provide an inward force on the storage drawer to minimize lateral movement of the storage drawer relative to the enclosure, wherein the drawer stabilizer includes a mount system and a biasing system, the mount system includes a mount post coupled to the enclosure and arranged to extend through a mount post aperture formed in the storage-drawer support and a fastener coupled to the mount post and spaced apart from the storage-drawer support by the biasing system.

2. The storage device of claim 1, wherein the biasing system includes a support flange coupled to the storage-drawer support and a biasing spring extending from the enclosure to the support flange and configured to provide the inward force on the storage drawer.

3. The storage device of claim 1, wherein the mount system is configured to couple the storage-drawer support to the at least one wall of the enclosure and the biasing system is arranged between the at least one wall of the enclosure and the storage-drawer support and configured to bias the storage-drawer support inwardly toward the internal space of the enclosure.

4. The storage device of claim 3, wherein the biasing system includes a support flange coupled to the storage-drawer support and a biasing spring that extends from the at least one wall of the enclosure to the support flange and the biasing spring configured to provide the inward force on the storage drawer.

5. The storage device of claim 4, wherein the biasing spring is one of a coil spring, a leaf spring, and a wire spring.

6. The storage device of claim 4, wherein the mount post is coupled to the at least one wall of the enclosure and is arranged to extend through the mount post aperture formed in the storage-drawer support and a mount post aperture formed in the support flange of the biasing system, and wherein the biasing spring extends around the mount post.

7. The storage device of claim 3, wherein the biasing system includes a support flange coupled to the storage-drawer support and a plurality of biasing springs spaced apart along the support flange that each extend from the at least one wall of the enclosure to the support flange and the plurality of biasing springs configured to provide the inward force on the storage drawer.

8. The storage device of claim 3, wherein the biasing system includes at least two support flanges arranged in spaced apart relation to each other and coupled to the storage-drawer support and at least two biasing springs that each extend from the at least one wall of the enclosure to one of the at least two support flanges and the biasing springs configured to provide the inward force on the storage drawer.

9. A storage device comprising an enclosure including a plurality of walls that cooperate to define an internal space within the enclosure and a storage-drawer support coupled to at least one wall in the internal space, a plurality of storage drawers movable relative to the storage-drawer support along respective paths within the internal space from a closed position to an opened position, the storage drawers contained within the internal space in the closed position and having a portion located in the internal space and a portion located outside the internal space in the opened position, and a drawer stabilizer coupled to the enclosure between the at least one wall and the storage-drawer support, the drawer stabilizer configured to provide an inward force on the storage drawer to minimize lateral movement of the plurality of storage drawers relative to the enclosure, wherein the drawer stabilizer includes a mount system and a biasing system, the mount system includes a mount post coupled to the enclosure and arranged to extend through a mount post aperture formed in the storage-drawer support and a fastener coupled to the mount post and spaced apart from the storage-drawer support by the biasing system.

10. The storage device of claim 9, wherein the biasing system includes a support flange coupled to the storage-drawer support and a biasing spring extending from the enclosure to the support flange and configured to provide the inward force on the storage drawers.

11. The storage device of claim 9, wherein the mount system is configured to couple the storage-drawer support to the at least one wall of the enclosure and the biasing system is arranged between the at least one wall of the enclosure and the storage-drawer support and configured to bias the storage-drawer support inwardly toward the internal space of the enclosure.

12. The storage device of claim 11, wherein the biasing system includes a support flange coupled to the storage-drawer support and a biasing spring that extends from the at least one wall of the enclosure to the support flange and the biasing spring configured to provide the inward force on the storage drawer.

13. The storage device of claim 12, wherein the mount post is coupled to the at least one wall of the enclosure and arranged to extend through the mount post aperture formed in the storage-drawer support and a mount post aperture formed in the support flange of the biasing system, and wherein the biasing spring extends around the mount post.

14. The storage device of claim 11, wherein the biasing system includes at least two support flanges arranged in spaced apart relation to each other and coupled to the storage-drawer support and at least two biasing springs that each extend from the at least one wall of the enclosure to one of the at least two support flanges and the biasing springs configured to provide the inward force on the storage drawer.

15. The storage device of claim 9, wherein the storage-drawer support includes a first support unit coupled to a first side wall included in the plurality of walls and a second support unit coupled to a second side wall included in the plurality of walls, and wherein each of the first support unit and the second support unit includes a plurality of support beams spaced apart from one another from a floor wall to a ceiling wall included in the plurality of walls to provide gaps between adjacent support beams included in the plurality of support beams to receive the left and right sides of the plurality of storage drawers, and wherein the drawer stabilizer is coupled to the enclosure between one of the first side wall and the second side wall and the respective first support unit and second support unit of the storage-drawer support.

16. A storage device comprising an enclosure including a plurality of walls that cooperate to define an internal space within the enclosure and a storage-drawer support, the plurality of walls including a floor wall, a ceiling wall spaced apart from the floor wall, a pair of side walls that extend between and interconnect the floor and ceiling walls to define the internal space of the enclosure, and the storage-drawer support including a first support unit coupled to a first side wall included in the pair of side walls and a second support unit coupled to a second side wall included in the pair of side walls, a storage drawer movable relative to the first and second support units of the storage-drawer support along a path within the internal space from a closed position to an opened position, the storage drawer contained within the internal space in the closed position and the storage drawer having a portion located in the internal space and a portion located outside the internal space in the opened position, and a first drawer stabilizer coupled to the enclosure between first side wall and the first support unit of the storage-drawer support and a second drawer stabilizer coupled to the enclosure between the second side wall and the second support unit of the storage-drawer support, the first and second drawer stabilizers configured to provide an inward force on the storage drawer to minimize lateral movement of the storage drawer relative to the enclosure, wherein the first and second drawer stabilizers each include a mount system configured to couple the respective first support unit and second support unit of the storage-drawer support to the respective first side wall and second side wall of the enclosure and a biasing system arranged between the respective first side wall and second side wall of the enclosure and the respective first support unit and second support unit of the storage-drawer support, the biasing system configured to bias the respective first support unit and second support unit inwardly toward the internal space of the enclosure, and wherein each mount system includes a mount post coupled to the enclosure and arranged to extend through a mount post aperture formed in the storage-drawer support and a fastener coupled to the mount post and spaced apart from the storage-drawer support by the biasing system.

17. The storage device of claim 16, wherein the biasing system includes a support flange coupled to the respective first support unit and second support unit of the storage-drawer support and at least one biasing spring that extends from the respective first side wall and second side wall of the enclosure to the support flange, and the at least one biasing spring configured to provide the inward force on the storage drawer.

* * * * *